US005683265A

United States Patent [19]

Allen et al.

[11] Patent Number: 5,683,265

[45] Date of Patent: Nov. 4, 1997

[54] BARREL PLUG HAVING INSULATION DISPLACEMENT TERMINALS

[75] Inventors: Roy C. Allen, Mesquite; Paul J. Offer, Jr., Dallas, both of Tex.

[73] Assignee: Lucent Technologies Inc., Murray Hill, N.J.

[21] Appl. No.: 539,951

[22] Filed: Oct. 6, 1995

[51] Int. Cl.[6] ..... H01R 4/24

[52] U.S. Cl. ..... 439/394

[58] Field of Search ..... 439/391, 394, 439/395, 406, 668, 669, 580–581, 425–427, 433.1

[56] References Cited

U.S. PATENT DOCUMENTS

| | | | |
|---|---|---|---|
| 4,339,166 | 7/1982 | Dayton | 439/425 |
| 4,352,240 | 10/1982 | Komada | 439/427 |
| 4,708,414 | 11/1987 | Lam | 439/427 |
| 4,775,336 | 10/1988 | Paulo | 439/733.1 |
| 5,085,594 | 2/1992 | Kaelin | 439/427 |
| 5,318,458 | 6/1994 | Thörner | 439/427 |
| 5,494,454 | 2/1996 | Johnsen | 439/394 |

*Primary Examiner*—Neil Abrams
*Assistant Examiner*—Brian J. Biggi

[57] ABSTRACT

A barrel plug for an insulated electrical cable, a power cord and a method of manufacturing the barrel plug. The barrel plug comprises: (1) an annular outer terminal having an outer terminal extension extending from an end thereof and terminating in a first insulation displacement terminal, (2) an inner terminal located coaxially within the annular outer terminal and having an inner terminal extension extending from an end thereof and terminating in a second insulation displacement terminal and (3) an insulative housing having a first end for receiving the outer and inner terminals, the housing holding the outer and inner terminals in a predetermined location to place the first and second insulation displacement terminals in a predetermined alignment, the housing further having a second end for receiving the electrical cable, the first and second insulation displacement terminals adapted to displace an insulation of the electrical cable to make electrical contact with respective first and second conductors of the electrical cable to thereby electrically couple the outer and inner terminals to the electrical cable for transmission of electrical current therebetween.

11 Claims, 3 Drawing Sheets

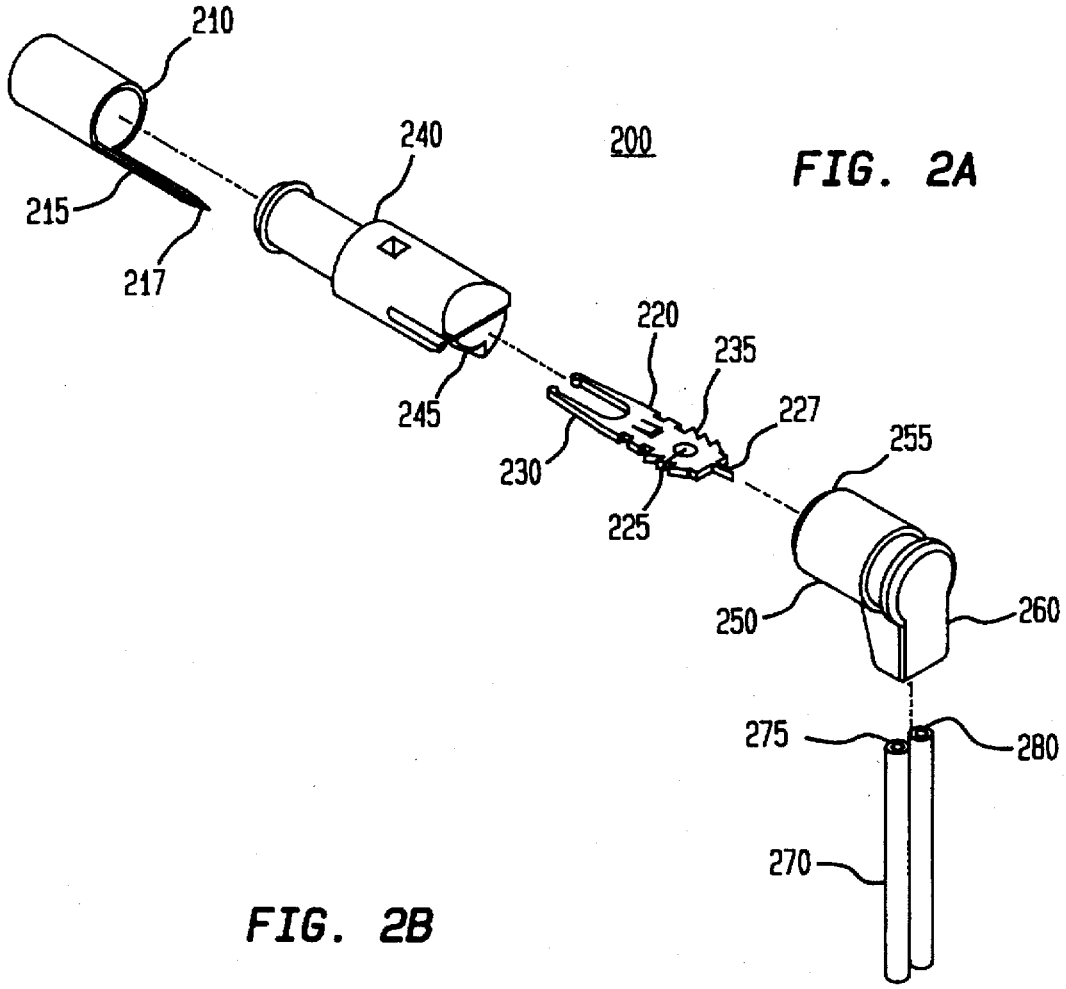
FIG. 2A
FIG. 2B
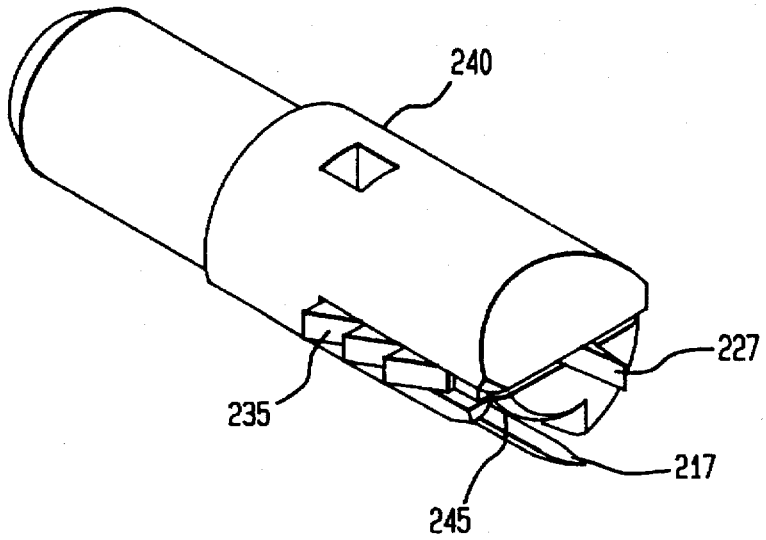

BARREL PLUG HAVING INSULATION DISPLACEMENT TERMINALS

TECHNICAL FIELD OF THE INVENTION

The present invention is directed, in general, to a coaxial "barrel" plug and, more specifically, to a barrel plug having a structure that provides improved strain relief and is more easily manufacturable than prior art barrel plugs.

BACKGROUND OF THE INVENTION

Electrical cables are used to carry electrical power to a vast array of electronic devices, including audio, computer and communications equipment. Often, a connector joins the cable to the device to allow the cable to separate from the device. This is particularly desirable when the cable is integral with a power converter (found in applications requiring the electrical power delivered to the device to be altered).

One type of connector frequently used in this environment comprises a so-called "barrel" plug including coaxial outer and spring-loaded inner terminals held in a generally fixed arrangement with respect to one another by an insulative housing. A barrel plug is designed to mate with a male receptacle or jack mounted on the device having a peripheral, spring-loaded terminal positioned for contact with the outer terminal and a center terminal positioned for contact with the spring-loaded inner terminal. A two-conductor electrical cable carrying the power to the electronic device terminates in the insulative housing and joins with the outer and inner terminals of the barrel plus.

The prior art manufacturing process for barrel plugs is generally as follows. First, an outer terminal is cut from a length of tube and deburred. Second, an annular insulator is insert-molded within the outer terminal. Third, a central terminal, often in the form of a tuning fork, is inserted into a void within the annular insulator. The insulator thereby electrically insulates the outer terminal from the central terminal. The tuning fork is designed to accept (between tynes thereof), and resiliently bear against, the male center terminal that is part of the mating receptacle or jack.

Fourth, separate conductors of the electrical cable to be coupled to the plug are stripped of their insulation at one end and the bared ends tinned with solder. Fifth, the tinned, bared ends are soldered to the outer and inner terminals, respectively, to effect an electrical connection. Sixth and finally, the cable and plug are encapsulated together in an overmolding process, thereby resulting in a jacket for the plug that preferably provides a handle and strain relief for the cable.

As is apparent, the prior art manufacturing technique for barrel plugs is an intricate, labor-intensive affair and, accordingly, is only economically justified in other countries, where labor costs are negligible. Further, environmental concerns surround the required soldering operations, providing an additional barrier to domestic practice of the prior art technique.

Despite these shortcomings, the demand for barrel plugs (measured in millions per year) continues to increase in light of the proliferation of electronic devices at business and in the home. Also, pressure is mounting for domestic production of components, whenever possible, to shorten component supply lines and increase domestic employment. Accordingly, the market is applying significant pressure for a domestically-producible barrel plug.

Accordingly, what is needed in the art is a less expensive barrel plug and a less labor-intensive and more environmentally sound method of manufacturing therefor. Even slight per unit plug manufacturing cost reduction is significant, given the sheer quantity of barrel plugs produced annually.

SUMMARY OF THE INVENTION

To address the above-discussed deficiencies of the prior art, the present invention provides a barrel plug for an insulated electrical cable, a power cord and a method of manufacturing the barrel plug. The barrel plug comprises: (1) an annular outer terminal having an outer terminal extension extending from an end thereof and terminating in a first insulation displacement terminal, (2) an inner terminal located coaxially within the annular outer terminal and having an inner terminal extension extending from an end thereof and terminating in a second insulation displacement terminal and (3) an insulative housing having a first end for receiving the outer and inner terminals, the housing holding the outer and inner terminals in a predetermined location to place the first and second insulation displacement terminals in a predetermined alignment, the housing further having a second end for receiving the electrical cable, the first and second insulation displacement terminals adapted to displace an insulation of the electrical cable to make electrical contact with respective first and second conductors of the electrical cable to thereby electrically couple the outer and inner terminals to the electrical cable for transmission of electrical current therebetween.

The present invention provides a coaxial barrel plug featuring insulation displacement terminals, eliminating the prior art need for soldering. Further, the present invention introduces a premolded body, eliminating a need for overmolding. The present invention therefore introduces a barrel plug that can be mass produced by machine, substantially reducing manufacturing costs.

In a preferred embodiment of the present invention, the barrel plug further comprises an insulative intermediate body located between the outer and inner terminals for further holding the outer and inner terminals in the predetermined location.

As will be seen, the intermediate body replaces the insert-molded annular insulator of the prior art. In more preferred embodiments, the intermediate body may include features to orient the intermediate body with respect to the housing (thereby properly orienting the first and second insulation displacement terminals), to retain the intermediate body within the housing or to receive the outer terminal extension. The present invention, however, does not require a separate intermediate body, as the housing itself may be modified to hold the outer and inner terminals in place.

In a preferred embodiment of the present invention, the inner terminal has a pair of opposing tynes adapted to accept therebetween, and resiliently bear against, a male center terminal of a mating receptacle. The opposing tynes preferably spread apart when the male center terminal is placed therebetween. Alternatively, the inner terminal may be of an annular configuration or, in fact, of any configuration adapted to receive and make acceptable electrical contact with the male center terminal.

In a preferred embodiment of the present invention, the first end includes a key structure for orienting the outer and inner terminals with respect to the first end. The present invention preferably provides automatic alignment of the first and second insulation displacement terminals so they may correctly displace the insulation of the electrical cable and to maintain correct polarity.

In a preferred embodiment of the present invention, the outer and inner terminals are translatable from a disengaged position to an engaged position, the first and second insulation displacement terminals displacing the insulation of the electrical cable when the outer and inner terminals are in the engaged position. Thus, the plug may be manufactured as a separate unit and later joined to an electrical cable by (1) inserting the electrical cable into the second end of the housing and (2) translating the outer and inner terminals into the engaged position to displace the insulation of the electrical cable.

In a preferred embodiment of the present invention, the inner terminal has a barbed edge for engaging an inner surface of the first end of the housing substantially to prevent the inner terminal from being removed from the first end. As will be shown, the barbed edge restricts the inner terminal to unidirectional motion, locking the inner terminal within the first end.

In a preferred embodiment of the present invention, the first and second insulation displacement terminals intersect the first and second conductors, respectively, substantially at a right angle. As will be shown, this right-angle arrangement offers strain relief to the electrical cable. However, it should be understood that, while insulation displacement terminals are designed to intersect insulation at a substantially right angle, the present invention may provide an acute angle of attack for the insulation displacement terminals.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which:

FIG. 2A illustrates an exploded isometric view of a barrel plug embodying the present invention;

FIG. 2B illustrates an exploded isometric view of the insulative intermediate housing of FIG. 2A;

DETAILED DESCRIPTION

Figure 1:
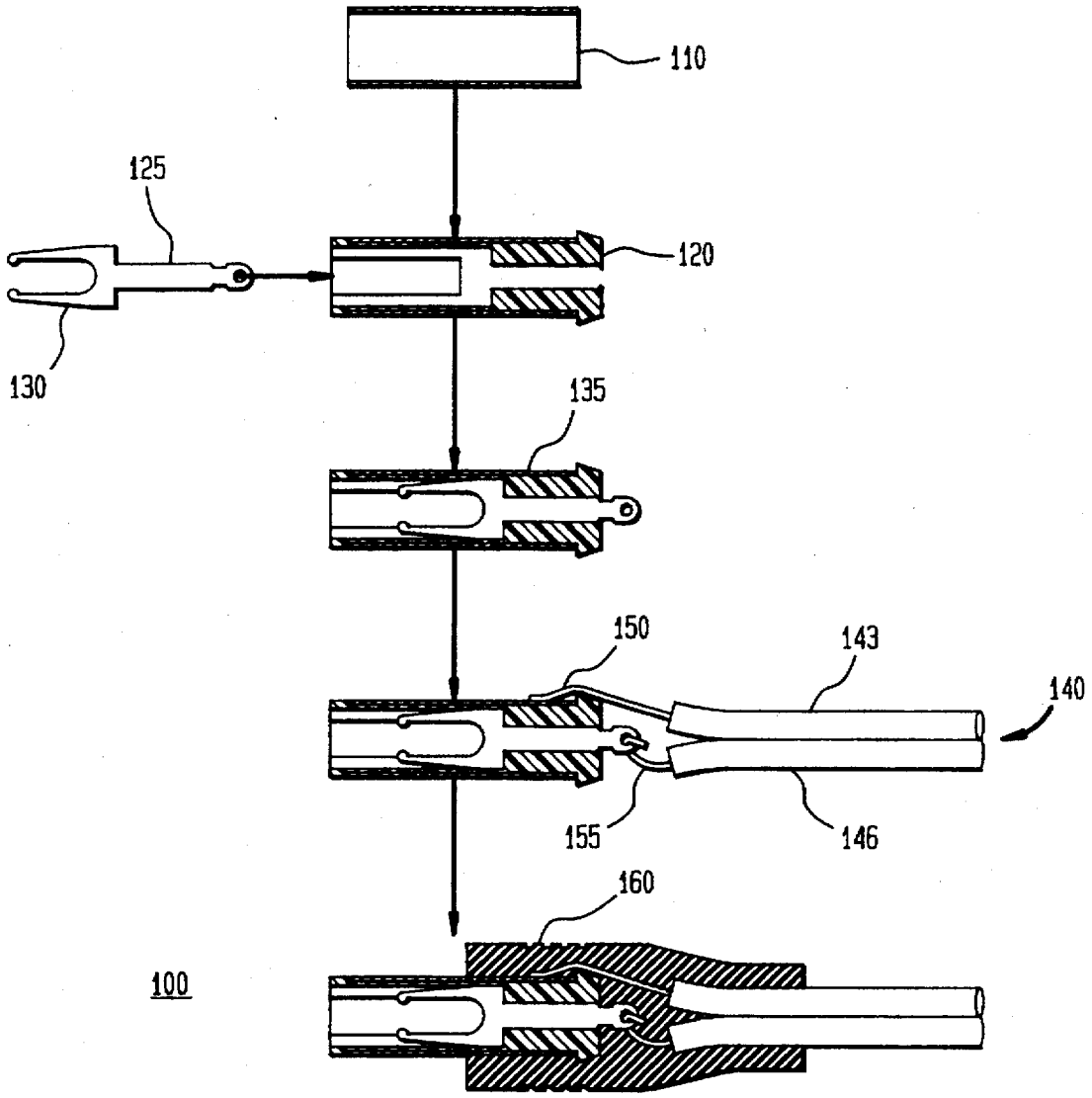
FIG. 1 (PRIOR ART)
FIG. 1 illustrates a sectional view of a prior art barrel plug.

Referring initially to FIG. 1, illustrated is a sectional view of a prior art barrel plug 100. The prior art manufacturing process for barrel plugs 100 is generally as follows. First, an outer terminal (typically in a barrel configuration) 110 is cut from a length of tube and deburred. The outer terminal 110 is generally nickel plated. Second, an annular insulator 120 is insert-molded within the outer terminal 110. Third, a central terminal 125, often in the form of a tuning fork, is inserted into a void within the annular insulator 120. The annular insulator 120 thereby electrically insulates the outer terminal 110 from the central terminal 125 by providing a dielectric separation therebetween. The central terminal 125 is designed to accept (between tynes 130 thereof), and resiliently bear against, a male center terminal that is part of the mating receptacle or jack (not shown). The male center terminal of the mating jack consists of a cylindrical post with an outside diameter sized to allow insertion between the tynes 130.

Fourth, separate conductors 143, 146 of an electrical cable 140 to be coupled to the plug 100 are stripped of their insulation (not shown) at one end and the bared ends 150, 155 tinned with solder. The electrical cable 140 is typically a parallel leg integrally insulated cable. Prior to stripping the ends of the insulation, the blunt cut leads of the cable are split apart a specified distance to facilitate the assembly process. Fifth, the tinned, bared ends 150, 155 are soldered to the outer and central terminals 110, 125, respectively, to effect an electrical connection. Sixth and finally, the cable 140 and plug assembly 135 are encapsulated together in an overmolding process, thereby resulting in a jacket 160 for the plug/cable assembly that preferably covers the solder connections and provides a handle and strain relief for the cable 140.

Again, the manufacturing technique for the prior art barrel plug 100 is an intricate, labor-intensive affair and, accordingly, is not cost effective to produce, especially in view of increasing competition. Additionally, the environmental concerns surrounding the required soldering operations provide an additional barrier to the production of the prior art barrel plug 100.

Turning now to FIG. 2A, illustrated is an exploded isometric view of a barrel plug 200 embodying the present invention. The barrel plug 200 includes an annular outer terminal 210 having an outer terminal extension 215 extending from an end thereof. The outer terminal extension 215 has a first insulation displacement terminal 217 extending therefrom.

The barrel plug 200 also includes an inner terminal 220 having an inner terminal extension 225 extending from an end thereof. The inner terminal extension 225 has a second insulation displacement terminal 227 extending therefrom. The inner terminal 220 is located coaxially within the annular outer terminal 210. The inner terminal 220 is illustrated with a pair of opposing tynes 230 to accept therebetween, and resiliently bear against, a male center terminal of a mating receptacle (see FIG. 3). Alternatively, the inner terminal 220 may be of an annular configuration or, in fact, of any configuration adapted to receive and make acceptable electrical contact with the male center terminal. The inner terminal 220 is also illustrated with a barbed edge 235. The purpose and advantage of the barbed edge 235 will be hereinafter described.

In the illustrated embodiment, an insulative intermediate body 240 is shown located between the outer and inner terminals 210, 220 for further holding the outer and inner terminals 210, 220 in the predetermined location. The present invention, however, does not require a separate insulative intermediate body 240 to hold the outer and inner terminals 210, 220 in place.

Additionally, the barrel plug 200 includes an insulative housing 250 with a first end 255 for receiving the outer and inner terminals 210, 220; the housing 250 thereby holds the outer and inner terminals 210, 220 in a predetermined location to place the first and second insulation displacement terminals 217, 227 in a predetermined alignment. The housing 250 further has a second end 260 for receiving an electrical cable 270. The first and second insulation displacement terminals 217, 227 are adapted to displace an insulation (not shown) of the electrical cable 270 to make electrical contact with respective first and second conductors 275, 280 of the electrical cable 270. While the first and second insulation displacement terminals 217, 227 are illustrated intersecting the first and second conductors 275, 280, substantially at a right angle to offer strain relief to the electrical cable 270, it should be understood that other orientations are well within the scope of the present invention. The electrical contact therefore electrically couples the outer and inner terminals 210, 220 to the electrical cable 270 for transmission of electrical current therebetween.

As previously mentioned, the inner terminal 220 has a barbed edge 235. The barbed edge 235 engages the inner surface of the first end 255 of the housing 250 thereby restricting the inner terminal 220 to unidirectional motion, locking the inner terminal 220 within the first end 255. While the barbed edge 235 assists in providing a secure union between the inner terminal 220 and the housing 250, the inner terminal 220 may engage the inner surface of the first end 255 of the housing 250 without the implementation of the barbed edge 235.

In the illustrated embodiment, the first end 255 of the housing 250 includes a key structure (see FIG. 2C) for orienting the outer and inner terminals 210, 220 with respect to the first end 255. When incorporating the insulative intermediate body 240, a matching key structure 245 further enhances the orientation of the outer and inner terminals 210, 220 with respect to the first end 255. However, the present invention provides automatic alignment of the first and second insulation displacement terminals 217, 227 in the absence of the key structure and the insulative intermediate body 240 so that the first and second insulation displacement terminals 217, 227 may correctly displace the insulation of the electrical cable 270 and to maintain correct polarity.

The present invention therefore provides a coaxial barrel plug 200 featuring several advantages that displace the prior art barrel plug 100. First, the first and second insulation displacement terminals 217, 227 eliminate the prior art need for soldering. Second, the present invention introduces a premolded body, eliminating a need for overmolding. Third, the insulative intermediate body 240 replaces the insert-molded annular insulator of the prior art. Fourth, the outer and inner terminals 210, 220 can be efficiently manufactured by a punch and form process and compactly stored on a continuous reel. Fifth, the manufacture of the barrel plug 200 is well suited for manual assembly or fully automated assembly line production.

Turning now to FIG. 2B, illustrated is an exploded isometric view of the insulative intermediate housing 240 of FIG. 2A. The insulative intermediate body 240 as presented with respect to FIG. 2A is clearly illustrated with the first insulation displacement terminal 217 associated with the outer terminal 210 protruding therefrom; the second insulation displacement terminal 227 and the barbed edge 235 associated with the inner terminal 220 are also illustrated protruding from the insulative intermediate body 240. Additionally, the matching key structure 245 is clearly displayed in the illustrated embodiment. Again, the insulative intermediate body 240 is employed to further hold the outer and inner terminals 210, 220 in the predetermined location. The present invention, however, does not require a separate insulative intermediate body 240 to hold the outer and inner terminals 210, 220 in place.

Figure 2C:
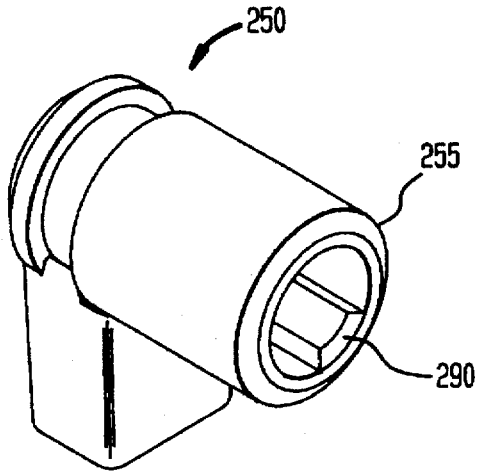
FIG. 2C illustrates a reverse angle exploded isometric view of the insulative housing of FIG. 2A.

Turning now to FIG. 2C, illustrated is a reverse angle exploded isometric view of the insulative housing 250 of FIG. 2A. The key structure 290 as presented with respect to FIG. 2A is clearly illustrated at the first end 255 of the housing 250. With continuing reference to FIG. 2A, the key structure supports the orientation of the outer and inner terminals 210, 220 with respect to the first end 255. Again, when incorporating the insulative intermediate body 240, the matching key structure 245 further enhances the orientation of the outer and inner terminals 210, 220 with respect to the first end 255. However, once again, the present invention provides automatic alignment of the first and second insulation displacement terminals 217, 227 in the absence of the key structure and the insulative intermediate body 240 so that the first and second insulation displacement terminals 217, 227 may correctly displace the insulation of the electrical cable 270 and to maintain correct polarity.

Figure 3:
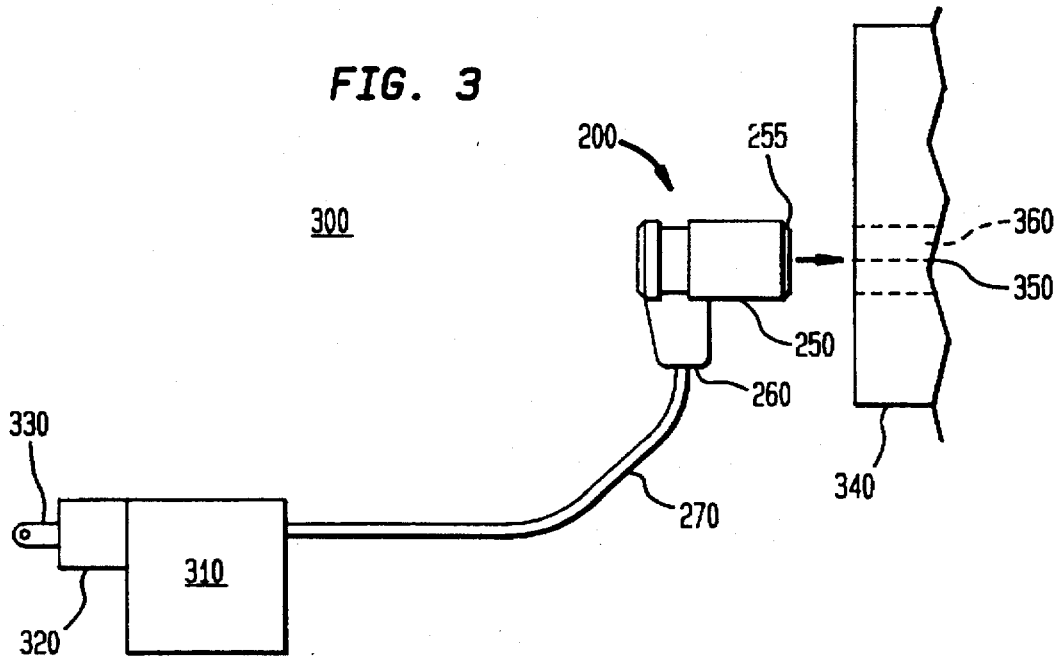
FIG. 3 illustrates a schematic view of a power cord, including a power conversion circuit and the barrel plug of FIG. 2.

Turning now to FIG. 3, illustrated is a schematic view of a power cord 300, including a power conversion circuit 310 and the barrel plug 200 of FIG. 2A. The power cord 300 includes a line power plug 320 having blades 330 for connection to a line power source (not shown). The power conversion circuit 310, coupled to the line power plug 320, converts power from the line power source to power of a predetermined voltage or current for an electronic system (e.g. a computer peripheral) 340. With continuing reference to FIG. 2A, the barrel plug 200, again, includes the annular outer terminal 210 and the inner terminal 220 located coaxially within the annular outer terminal 210. The barrel plug 200 further includes the insulative housing 250 having the first end 255 for receiving the outer and inner terminals 210, 220 and the second end 260 for receiving the electrical cable 270 coupled to the power conversion circuit 310. Again, the first and second insulation displacement terminals 217, 227 located in the housing 250 displace the insulation of the electrical cable 270 to make electrical contact with the respective first and second conductors 275, 280 of the electrical cable 270 to thereby electrically couple the outer and inner terminals 210, 220 to the line power plug 320 for transmission of electrical current therebetween. Furthermore, the inner terminal 220 includes a pair of opposing tynes 237 to accept therebetween, and resiliently bear against, a male center terminal 350 of a mating receptacle 360 of the electronic system 340. Alternatively, the inner terminal 220 may be of an annular configuration or, in fact, of any configuration adapted to receive and make acceptable electrical contact with the male center terminal 350.

Although the present invention has been described in detail, those skilled in the art should understand that they can make various changes, substitutions and alterations herein without departing from the spirit and scope of the invention in its broadest form.

What is claimed is:

1. A barrel plug for an insulated electrical cable, and comprising:

an annular outer terminal having an outer terminal extension extending from an end thereof and terminating in a first insulation displacement terminal;

an inner terminal located coaxially within said annular outer terminal and having an inner terminal extension extending from an end thereof and terminating in a second insulation displacement terminal; and an insulative housing having a first end for receiving said outer and inner terminals, said housing holding said outer and inner terminals in a predetermined location to place said first and second insulation displacement terminals in a predetermined alignment, said housing further having a second end for receiving said electrical cable, said first and second insulation displacement terminals adapted to displace an insulation of said electrical cable to make electrical contact with respective first and second conductors of said electrical cable to thereby electrically couple said outer and inner terminals to said electrical cable for transmission of electrical current therebetween.

2. The barrel plug as recited in claim 1, further comprising an insulative intermediate body located between said outer and inner terminals for further holding said outer and inner terminals in said predetermined location.

3. The barrel plug as recited in claim 1 wherein said inner terminal has a pair of opposing tynes adapted to accept therebetween, and resiliently bear against, a male center terminal of a mating receptacle.

4. The barrel plug as recited in claim 1 wherein said first end includes a key structure for orienting said outer and inner terminals with respect to said first end.

5. The barrel plug as recited in claim 1 wherein said outer and inner terminals are translatable from a disengaged position to an engaged position, said first and second insulation displacement terminals displacing said insulation of said electrical cable when said outer and inner terminals are in said engaged position.

6. The barrel plug as recited in claim 1 wherein said inner terminal has a barbed edge for engaging an inner surface of said first end of said housing substantially to prevent said inner terminal from being removed from said first end.

7. The barrel plug as recited in claim 1, further comprising an insulative intermediate body located between said outer and inner terminals and having a recess therein for accepting said outer terminal extension.

8. The barrel plug as recited in claim 1 wherein said first and second insulation displacement terminals intersect said first and second conductors, respectively, substantially at a right angle.

9. A barrel plug for an insulated electrical cable having nonconcentric parallel conductors, comprising:

an annular outer terminal having an outer terminal extension extending from an end thereof and terminating in a first insulation displacement terminal;

an inner terminal located coaxially within said annular outer terminal and having an inner terminal extension extending from an end thereof and terminating in a second insulation displacement terminal;

an insulative intermediate body located between said outer and inner terminals for holding said outer and inner terminals in a predetermined location; and an insulative housing having a first end for receiving said outer and inner terminals and said intermediate body, said first end and said intermediate body including a key structure for orienting said outer and inner terminals with respect to said first end, said housing further holding said outer and inner terminals in said predetermined location to place said first and second insulation displacement terminals in a predetermined alignment, said housing further having a second end for receiving said electrical cable, said outer and inner terminals translatable from a disengaged position to an engaged position, said first and second insulation displacement terminals displacing said insulation of said electrical cable when said outer and inner terminals are in said engaged position to make electrical contact with respective first and second conductors of said electrical cable to thereby electrically couple said outer and inner terminals to said electrical cable for transmission of electrical current therebetween.

10. The barrel plug as recited in claim 9 wherein said inner terminal has a pair of opposing tynes adapted to accept therebetween, and resiliently bear against, a male center terminal of a mating receptacle.

11. The barrel plug as recited in claim 9 wherein said first and second insulation displacement terminals intersect said first and second conductors, respectively, substantially at a right angle.

* * * * *